United States Patent [19]

Notelteirs et al.

[11] 4,367,428

[45] Jan. 4, 1983

[54] HALOGEN INCANDESCENT LAMP

[75] Inventors: Victor R. Notelteirs; Gustaaf F. R. Siaens, both of Eindhoven, Netherlands

[73] Assignee: U.S. Philips Corporation, New York, N.Y.

[21] Appl. No.: 227,891

[22] Filed: Jan. 23, 1981

[30] Foreign Application Priority Data

Feb. 5, 1980 [NL] Netherlands ..... 8000705

[51] Int. Cl.[3] ..... H01K 1/18; H01K 1/42

[52] U.S. Cl. ..... 313/222; 313/217

[58] Field of Search ..... 313/222, 217, 135

[56] References Cited

U.S. PATENT DOCUMENTS

| | | | |
|---|---|---|---|
| 3,445,713 | 5/1969 | Cardwell | 313/222 X |
| 3,543,078 | 11/1970 | Steinhart et al. | 313/222 X |
| 3,829,729 | 8/1974 | Westlund et al. | 313/222 X |

*Primary Examiner*—Robert Segal

*Attorney, Agent, or Firm*—Robert S. Smith

[57] ABSTRACT

Mains voltage halogen incandescent lamps according to the invention have at least one metal foil (25) incorporated in the pinch seal (22) of the lamp envelope (21) which extends into the cavity (23) enclosed by the lamp envelope (1) and is connected to an internal current conductor (29) situated entirely within said cavity (23). The lamps furthermore have a non-current-carrying supporting member (31) for said internal current conductor (29) which is embedded in the pinch seal (22) at a distance from the metal foil (25).

3 Claims, 3 Drawing Figures

HALOGEN INCANDESCENT LAMP

The invention relates to a mains voltage halogen incandescent lamp having a sealed vacuum-tight glass lamp envelope, which lamp envelope comprises a pinch seal in which metal foils connected to respective internal and external current conductors are incorporated as current leadthrough conductors, in the cavity of which lamp envelope a filament is accommodated in a halogen-containing gas and is connected to the internal current conductors, at least one of the metal foils extending from the pinch seal into the cavity of the lamp envelope and being there connected to a said internal current conductor situated entirely within said cavity. Such a lamp is shown in FIG. 8 of British Patent Specification No. 1,313,531.

The known lamp distinguishes, together with the other lamps described in the said Patent Specification, from conventional lamps in that the lamp set—i.e. the assembly of the components present in the cavity of the lamp envelope with the exception of the filament—is formed from sheet material in so far as its metal parts are concerned.

The internal current conductors in conventional halogen incandescent lamps extend from the cavity of the lamp envelope into the pinch seal where they are welded to a metal foil situated entirely within the pinch seal. Metal foils are used as current lead-through conductors in lamps in which the glass of the lamp envelope has a significantly lower coefficient of thermal expansion than metals, which is the case with glass having an $SiO_2$ content of at least 95% by weight, for example quartz glass. Consequently, in these lamps the glass of the pinch seal cannot enclose metal wires constituting the internal current conductors in a vacuum-tight manner, this in contrast with metal foils. A vacuum-tight connection of the glass of the pinch seal to the metal foils is achieved in that said foils are very thin (for example 30 $\mu$m) and have etched edges.

If in conventional mains voltage halogen incandescent lamps the filament fuses or an internal current conductor is attacked by halogen to such an extent as to fracture, a high current discharge arc is formed in the cavity of the lamp. Fast external fuses are not always capable of preventing, as a result of said discharge arc, the occurrence of a very rapid evaporation of the metal incorporated in the pinch seal, with the result that the pinch seal fractures and the lamp explodes.

It has now been found that when a discharge arc occurs in the cavity of a mains voltage halogen incandescent lamp of the kind mentioned in the opening paragraph, the part of the metal foil extending into said cavity fuses and, as a result, the arc extinguishes before fracture occurs. This must be ascribed to the fact that the part of the metal foil which extends into the cavity of the lamp envelope is not cooled by glass, which is the case with the part of said metal foil which is situated in the pinch seal and which is surrounded circumferentially by glass in a vacuum-tight manner.

In the lamp described in the opening paragraph the metal foil must at least partly support the lamp set. As a result of the lack of rigidity of the foil, this may result in an undefined position of the filament in the lamp envelope, as well as a high sensitivity to shock and vibration.

It is the object of the invention to provide a lamp of the kind described in the opening paragraph having a larger resistance to shock and vibration and less dependence of the position of the filament with respect to the lamp envelope on the position of the lamp.

The invention accordingly provides a lamp of the type described in the opening paragraph hereof, characterized in that the internal current conductor situated entirely in the cavity of the lamp envelope has a non-current-carrying supporting member one end of which is embedded in the pinch seal at a distance from the metal foils.

As a result of this measure a lamp is obtained which is not only safeguarded against explosion as a result of the formation of a discharge arc in the cavity of the lamp envelope, but also has a mechanically stable arrangement for the filament.

The supporting member may consist, for example, of a piece of wire, which at its one end is welded to the internal current conductor and is embedded in the pinch seal at its other end. Another very attractive possibility is that in which the supporting member and the relevant internal current conductor consist of one piece of material, for example a piece of wire, and the current conductor is bent near its point of connection to the metal foil so that the part of the piece of wire in the pinch seal serving as a supporting member is embedded at a distance from the foil so that it does not short circuit any part of the foil.

In another embodiment of the lamp in accordance with the invention the second internal current conductor is also situated entirely in the cavity of the lamp envelope and also has a respective supporting member.

The internal current conductors preferably have a circular cross-section. Such current conductors have a larger rigidity than conductors of metal sheet having a cross-section of the same area.

The lamps according to the invention may be used for many purposes, for example, film projection, photo and film studio illumination.

Embodiments of lamps according to the invention will now be described with reference to the accompanying drawing, of which:

Figure 1:
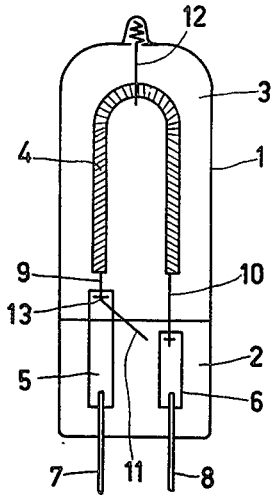
FIG. 1 is an elevation of a 110 V, 1000 W photo lamp.

In FIG. 1, a quartz glass lamp envelope 1 has a pinch seal 2 which bounds the cavity 3 of the lamp envelope 1. A filament 4 is accommodated in the cavity 3 in a gas containing hydrogen bromide. Metal foils 5 and 6 are embedded in the pinch seal 2 and are connected to external current conductors 7 and 8, respectively, and to internal current conductors 9 and 10 respectively.

The metal foil 5 extends from the pinch seal 2 into the cavity 3 and the internal current conductor 9 is situated entirely within the cavity 3. One end of a supporting member 11 for the internal current conductor 9 is embedded in the pinch seal 2 at a distance from the metal foils 5 and 6. The supporting member 11 and the internal current conductor 9 in this embodiment consist of a single piece of wire which is bent near the connection point 13 of the internal current conductor 9 to the metal foil 5. The filament 4 is supported centrally by a hook 12.

Figure 2:
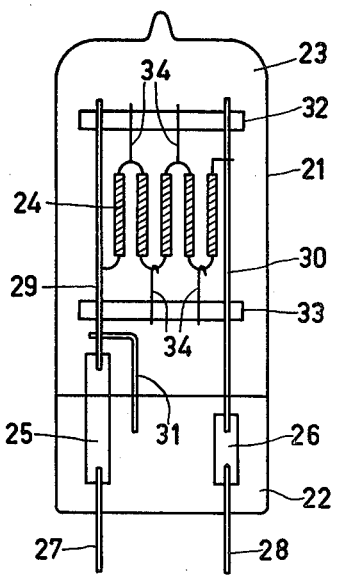
FIG. 2 is an elevation of a 220 V, 1000 W studio lamp.
Figure 3:
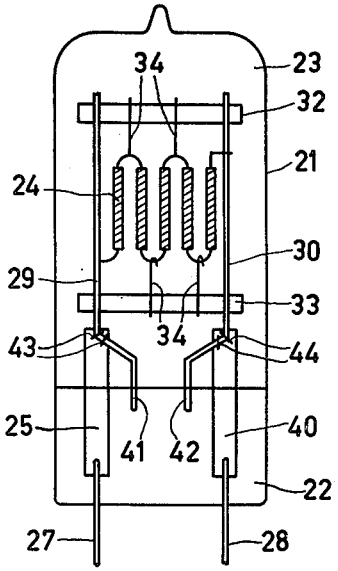
FIG. 3 is an elevation of a modified embodiment of the lamp shown in FIG. 2.

In FIGS. 2 and 3 a quartz glass envelope 21 has a pinch seal 22 and a cavity 23 filled with a hydrogen bromide-containing gas. A filament 24 is accommodated in the cavity 23 and is stretched, by means of hooks 34, between quartz glass beams 32 and 33 which are secured to internal current conductors 29 and 30.

In FIG. 2 two metal foils 25 and 26 are incorporated in the pinch seal and are connected to respective external current conductors 27 and 28 and respective internal current conductors 29 and 30. The metal foil 25 extends from the pinch seal 22 into the cavity 23 of the lamp envelope 21. The internal current conductor 29 is situated entirely within said cavity 23 and is supported by a supporting member 31 which at one end is fixed to said internal conductor, for example by welding and at its other end is embedded in the pinch seal 22 at a distance from the metal foils 25 and 26.

In FIG. 3 the two metal foils 25 and 40 incorporated in the pinch seal 22 each extend into the cavity 23 and both internal current conductors 29 and 30 connected to respective metal foils 25 and 40 are situated entirely within the cavity 23. Supporting members 41 and 42 with the respective internal current conductors 29, 30 are each formed from one piece of wire by bending the piece of wire near their connection points 43 and 44, respectively, to the relevant metal foil. The supporting members 41 and 42 are embedded in the pinch seal 22 at a distance from the metal foils 25 and 40 and from each other. The supporting members 41 and 42 are not current-carrying during operation of the lamp.

In experiments in which the filaments of the lamps shown were fused during operation, by means of a laser or by applying an excessive voltage, and a discharge arc was formed, it was found that the discharge arc extinguished as a result of the fusion of the metal foil part(s) extending into the cavity of the lamp envelope. Cracking of the pinch seal and explosion of the lamp were thereby prevented.

The same observation was made in lamps which were operated at their design voltage until they reached at the calculated instant the end of life as a result of fracture of the filament.

The stability of the position of the filament in the lamp envelope and the resistance to shock and vibration of the lamps was equal to that of conventional lamps in which the internal current conductors extend into the pinch seal and are connected therein to a respective metal foil and which are not provided with a supporting member.

What is claimed is:

1. A mains voltage halogen incandescent lamp having a sealed vacuum-tight glass lamp envelope, which lamp envelope comprises a pinch seal in which metal foils connected to respective internal and external current conductors are incorporated as current leadthrough conductors, in the cavity of which lamp envelope a filament is accommodated in a halogen containing gas and is connected to the internal current conductors, at least one of the metal foils extending from the pinch seal into the cavity of the lamp envelope and being there connected to an internal current conductor situated entirely within said cavity, characterized in that the internal current conductor situated entirely in the cavity of the lamp envelope has a non-current-carrying supporting member one end of which is embedded in the pinch seal at a distance from the metal foils.

2. A mains voltage halogen incandescent lamp as claimed in claim 1, characterized in that the supporting member with the relevant internal current conductor consists of one piece of material which is bent near the point of connection of the internal current conductor to the relevant metal foil.

3. A mains voltage halogen incandescent lamp as claimed in claim 1 or 2, characterized in that both internal current conductors are situated entirely in the cavity of the lamp envelope and each have a respective said supporting member.

* * * * *